United States Patent [19]

Watson

[11] 4,315,730

[45] Feb. 16, 1982

[54] BURNER CONTROL SYSTEM

[75] Inventor: Kenneth Watson, Croydon, England

[73] Assignee: Telegan Limited, Croydon, England

[21] Appl. No.: 120,130

[22] Filed: Feb. 11, 1980

[30] Foreign Application Priority Data

Feb. 9, 1979 [GB] United Kingdom ..... 4595/79

[51] Int. Cl.[3] ..... F23H 5/00

[52] U.S. Cl. ..... 431/76; 236/15 E

[58] Field of Search ..... 431/12, 90, 76; 236/15 E; 110/185, 186, 188; 122/448 R

[56] References Cited

U.S. PATENT DOCUMENTS

| | | | |
|---|---|---|---|
| 3,404,836 | 10/1968 | Hickam | 236/15 E |
| 3,503,553 | 3/1970 | Schomaker | 236/15 E X |
| 3,519,254 | 7/1970 | Putnam | 236/15 E |
| 3,723,047 | 3/1973 | de Livois | 236/15 E |
| 4,097,218 | 6/1978 | Womack | 236/15 E |
| 4,150,939 | 4/1979 | Hayes | 236/15 E |

*Primary Examiner*—Edward G. Favors

*Attorney, Agent, or Firm*—Oblon, Fisher, Spivak, McClelland & Maier

[57] ABSTRACT

The fuel supply to a boiler (11) is controlled by a fuel valve (17) driven by a motor (18) in response to measured steam pressure at (12) in relation to a demanded pressure. The motor (18) adjusts at the same time a damper (36) for supplying combustion air at (13). Air supply at (13) can also be controlled in response to the pressure drop across a register (38) as measured by airlines (51). The invention provides an over-riding control in response to too much or too little oxygen in the exhaust gases in the stack (15). The oxygen level is measured by a detector (26), and if it is outside limits set at (29) a motor (41) operates a valve (42) connected between the airlines (51). A timer with a contact T1 ensures that the control in response to oxygen level is only operative for a small part of each of a number of repeated 10 second cycles.

5 Claims, 1 Drawing Figure

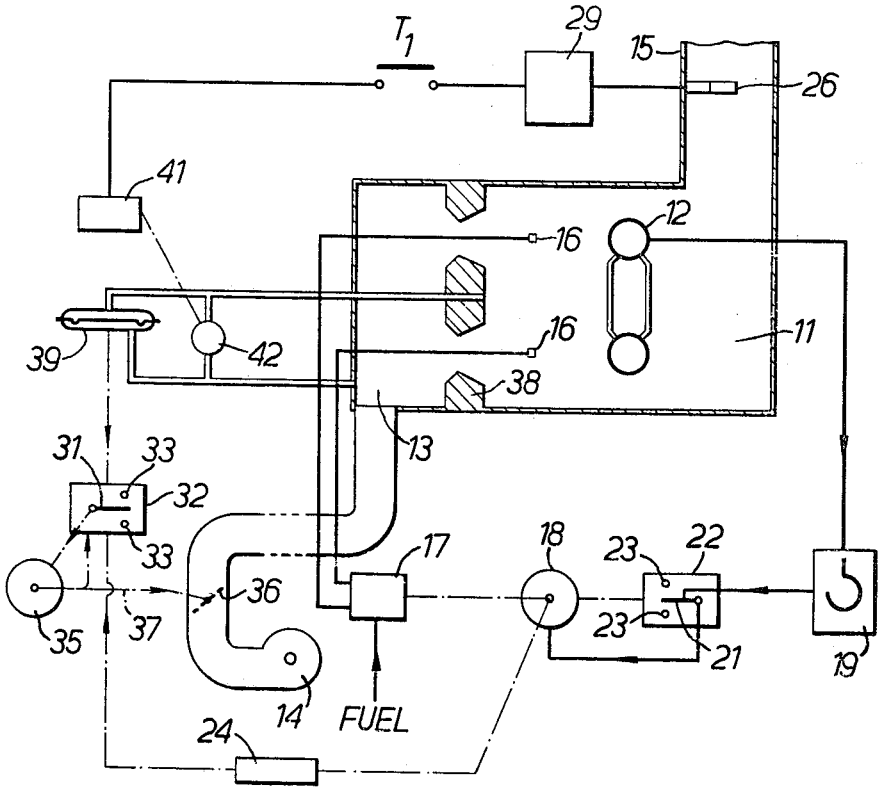
T1
29
15
26
41
12
16
16
11
39
42
38
13
31
33
32
33
17
18
23
22
36
23
21
35
37
19
14
FUEL
24

BURNER CONTROL SYSTEM

This invention relates to a burner control system and one object is to provide an over-riding or trimming control of the combustion in dependence upon the oxygen content in the exhaust gases.

The invention has particular application to a water tube boiler, for example used in marine propulsion where it is usual to have separate controls for the fuel supply, and for the supply of combustion air, each operating primarily in response to a different variable, but with their actions being interconnected. In such a system it is difficult to find an easy method of providing an over-riding control to prevent excessive oxygen in the exhaust gases, but that can be achieved in accordance with the present invention, by including means arranged to control the rate of supply of combustion air in dependence upon the pressure difference across the burner register, and by including a motor-driven valve interconnecting pressure lines from either side of the register, together with means for driving the valve motor in dependence on the oxygen level in the exhaust gas.

Normally, the rate of supply of fuel will be controlled in dependence upon the output steam pressure, with any change in the rate of fuel supply being arranged to adjust the rate of supply of combustion air accordingly. In turn, a change in the rate of supply of combustion air, as measured by the pressure difference across the burner register, can be arranged to adjust a damper associated with a forced draft fan for the combustion air to maintain the desired rate of supply.

That system would continue to operate as before provided the amount of oxygen in the exhaust gases was kept within predetermined limits, but in accordance with the present invention if the amount of oxygen in the products of combustion gets outside those predetermined limits, then the valve motor is operated to partly open, or partly close, the motor-driven valve to introduce a signal tending to adjust the rate of supply of combustion air to bring the oxygen level in the stack back within the limits. The lower limit will tend to correspond with there being insufficient air for complete combustion, while the upper limit will tend to correspond to there being too much excess air which requires heating and renders the combustion inefficient.

The oxygen level in the exhaust gas can be measured by a probe as described in U.S. Ser. No. 907,722 filed May 19, 1978, U.S. Pat. No. 4,238,185 published on Dec. 7, 1978 as German OLS. No. P. 2822770.5. The probe 26 and metering device 29 described in that specification can be used exactly as described there, except that instead of controlling a trim damper 33, it can control the valve motor referred to above.

In general terms the invention may be considered to be the use of the signal representing oxygen level in the exhaust gas to distort the air supply signal received by the boiler combustion controller.

The invention may be carried into practice in various ways, and one embodiment will now be described by way of example, with reference to the accompanying drawing, of which the single FIGURE is a diagram showing a marine water tube boiler controlled in accordance with the invention.

The boiler is conventional and includes a water tube chamber shown diagrammatically at 11, with a steam header 12, a wind box 13 supplied with combustion air from a motor driven fan 14, and a stack 15 for the exhaust gases. There are four oil burners 16 supplied with fuel through a fuel valve 17 controlled by a motor 18 primarily in response to steam pressure from the header 12, as measured by a Bourdon gauge 19 in accordance with a demanded steam pressure. Any variation from that set pressure as measured at the gauge 19 is arranged to move a contact arm 21 on a switch 22 which has a pair of fixed contacts 23.

The arrangement is only shown diagrammatically in the drawing, but the effect is that if the moving contact 21 makes contact with either of the fixed contacts 23, the motor 18 is energised to produce some opening or closing movement of the fuel valve 17, and also to move the switch 22 so that the contacts 23 move away from the moving contact 21 to a new position of adjustment in which the motor is not energised.

Adjustment of the fuel supply requires an adjustment of the combustion air supply, and accordingly there is a mechanical connection shown diagrammatically at 24 between the shaft of the motor 18 and the moving contact 31 of a second switch 32 having a pair of fixed contacts 33. The connection 24 will in general have some cam or other non-linear device for producing an appropriate movement of the contact 31 in accordance with a law determined by trial and error. The moving contact 31 controls a motor 35 for tending to open or close a damper 36 at the inlet to the blower 14 supplying air to the wind-box 13 over a mechanical connection shown diagrammatically at 37. The rate of increase or decrease or air supply will be approximately appropriate for any change in the fuel supply as controlled at 17. Operation of the motor 35 also readjusts the switch 32 to remove the energisation of the motor when the damper has been opened or closed an appropriate amount.

The damper 36 can be controlled independently of the fuel valve 17, and in accordance with a set rate of supply of combustion air. The actual rate of supply of combustion air can be determined by measuring the pressure drop across a register 38, comprising an aperture of preset size in the wind-box 13, and airlines from either side of the register 38 are supplied to a diaphragm device 39 which is also capable of adjusting the setting of the moving contact 31, so that the motor 35 controls the damper 36 to tend to keep the air supply at the set rate. The airlines are shown at 51.

Such a control system is satisfactory for maintaining a desired steam pressure at the header 12, and to maintain approximately the correct rate of air supply for any fuel setting.

However the present invention enables there to be an overriding control in dependence on the quantity of oxygen in the stack 15, which if kept between predetermined limits can ensure efficient combustion of the fuel.

Accordingly, a zirconia cell in a probe 26 mounted in the duct 15 as described in German Patent Specification No. P. 2822770.5 is connected to a metering device 29 which produces an output in one sense or the opposite sense, if the amount of oxygen in the stack 15 exceeds the predetermined limits in one sense or the other. On the other hand there is no output from the metering device 29, if the oxygen level remains between the predetermined limits which can be manually set in on the device 29 as described in the above German Specification. The output from the device 29 is connected to a motor 41 through a switch contact T1, which is only closed for a short part of a 10 second cycle, as described in that German Specification. The motor 41 drives a valve 42 connected across the pressure lines 43 from opposite sides of the register 38.

In normal operation, the valve 42 will be partly open to reduce the pressure drop as measured at the diaphragm 39 from that actually appearing across the register 38, and the motors 18 and 35 and their switches and the mechanical connection 24 will be set to control the boiler with that pressure drop at the valve 42.

However as soon as the oxygen level gets outside the predetermined limits, a signal appears at 41, and the motor tends to open or close the valve 42 in dependence on the sense of the signal, so that the diaphragm 39 receives an overriding signal even though there has been no change in the pressure drop across the register 38. That overriding or trimming signal products an adjustment of the setting of the damper 36 in the manner described above, so that the air supply is adjusted until once again the oxygen level in the stack 15 is between the predetermined limits which means that combustion is continuing efficiently.

Since the contact T1 is only closed for say, 2 or 3 seconds in a 10 second cycle, once the motor 41 has been energised to operate the valve 42, there will then be a period of 7 or 8 seconds in which there is no further signal supplied to the motor 41, and the system will have a chance to respond to that adjustment of the valve 42, before the next signal can be received. That time may be sufficient to correct the air supply, so that a further control signal may not be necessary, and the arrangement tends to prevent hunting of the control system.

An advantage of the invention is that the components 26, 29, 7, 41 and 42 can be fitted to an existing system quite simply, but to give a striking improvment on efficiency.

What I claim as my invention and desire to secure as Letters Patent is:

1. A control system for a burner having: separate controls for the fuel supply and for the supply of combustion air, means for controlling the separate controls in response respectively to a demand or output signal and to an air supply signal, means interconnecting the separate controls, and means responsive to excessive oxygen in the exhaust gasses for distorting the air supply signal, the control system further including a burner register and pressure lines wherein said pressure lines extend from either side of the register for providing the air supply signal, the system further including a motor driven valve, said motor driven valve interconnecting the pressure lines; and means for driving the valve motor in dependence on the oxygen level in the exhaust gas.

2. A system as claimed in claim 1 including means for adjusting the rate of supply of combustion air in response to a change in the rate of fuel supply.

3. A system as claimed in claim 1 including means for delivering a distorting signal only when the oxygen level is outside preset upper and lower limits.

4. A system as claimed in claim 3 including a timer having control cycles for rendering the distorting signal effective only during a part of each of a series of successive ones of said control cycles.

5. A system as claimed in claim 4 including a zirconia cell probe mounted in the burner stack for providing said distorting signal.

* * * * *